US008671597B2

(12) United States Patent
Gappy

(10) Patent No.: US 8,671,597 B2
(45) **Date of Patent: *Mar. 18, 2014**

(54) SNOW PLOW TOWING HITCH SYSTEM

(71) Applicant: Hamid A. Gappy, West Bloomfield, MI (US)

(72) Inventor: Hamid A. Gappy, West Bloomfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/657,450

(22) Filed: Oct. 22, 2012

(65) Prior Publication Data

US 2013/0167412 A1 Jul. 4, 2013

Related U.S. Application Data

(63) Continuation of application No. 12/716,557, filed on Mar. 3, 2010, now Pat. No. 8,291,622.

(60) Provisional application No. 61/236,149, filed on Aug. 24, 2009.

(51) Int. Cl.
*E01H 5/04* (2006.01)

(52) U.S. Cl.
USPC ..... 37/231; 37/232; 172/272

(58) Field of Classification Search
USPC ..... 37/231, 232, 235; 172/272
See application file for complete search history.

(56) References Cited

U.S. PATENT DOCUMENTS

| | | | |
|---|---|---|---|
| 3,587,751 | A | 6/1971 | Schmidt |
| 3,650,054 | A | 3/1972 | Hanson |
| 3,808,714 | A | 5/1974 | Reissinger et al. |
| 4,843,744 | A | 7/1989 | Jansen |
| 4,907,358 | A | 3/1990 | Moore |
| 5,109,618 | A | 5/1992 | Grubler et al. |
| 5,136,795 | A | 8/1992 | Rosenberg |
| 5,435,082 | A | 7/1995 | Frenette et al. |
| 6,202,328 | B1 | 3/2001 | Fulton |
| 6,240,658 | B1 | 6/2001 | Knutson et al. |
| 6,453,582 | B1 | 9/2002 | Fulton, III |
| 6,595,299 | B2 | 7/2003 | Heller |
| 6,618,965 | B1 | 9/2003 | Schultz et al. |
| 6,941,685 | B2 | 9/2005 | Goy et al. |
| 7,028,423 | B1 | 4/2006 | Curry |
| 7,226,268 | B2 | 6/2007 | Gustafson et al. |
| 7,841,109 | B2 | 11/2010 | Stevens et al. |

*Primary Examiner* — Jamie L McGowan

(74) *Attorney, Agent, or Firm* — The Weintraub Group, P.L.C.

(57) ABSTRACT

A snow plow towing hitch system removably attached to an existing vehicle hitch which is lightweight and compact to allow an individual to attach the snow plow towing hitch system to a vehicle hitch when needed and to remove and store it when not in use. The snow plow towing hitch system includes a connecting bar connected to a vehicle hitch, a vertical support bar attached to the connecting bar, a plow blade rotatably attached to the vertical support bar, and a spring attached to the vertical support bar and the plow blade to limit rotation of the plow blade. Another alternate embodiment of the snow plow towing hitch system comes in a kit form allowing the user to easily assemble the snow plow towing hitch for use and to disassemble for storage or to use portions as a snow shovel.

8 Claims, 4 Drawing Sheets

FIG 3
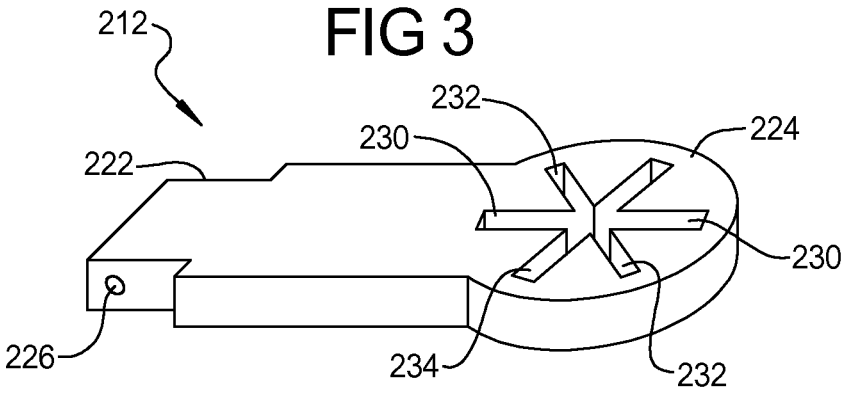
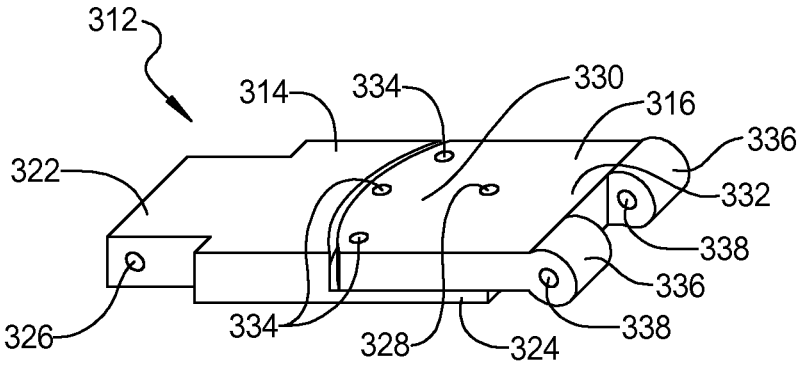
FIG 4
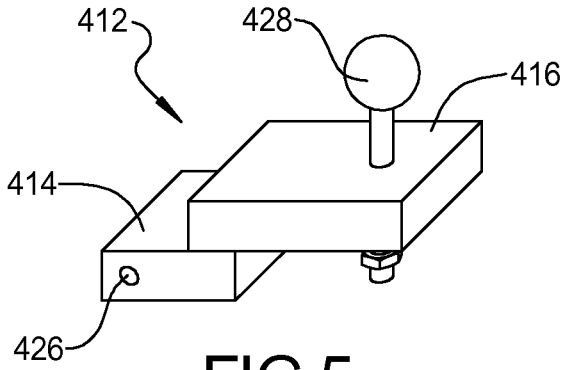
FIG 5

SNOW PLOW TOWING HITCH SYSTEM

CROSS REFERENCE TO RELATED APPLICATION

This application is a continuation of U.S. patent application Ser. No. 12/716,557, filed Mar. 3, 2010, which claims the benefit of U.S. Provisional Application 61/236,149, filed Aug. 24, 2009, the disclosures of which are hereby incorporated by reference.

BACKGROUND OF THE INVENTION

1. Field of the Invention

The present invention relates to a snow plow and, more particularly, to a snow plow removably attachable to a vehicle hitch.

2. Description of the Background Art

Snowfall affects daily living for millions of people each year. The accumulation of snow hinders pedestrian and vehicular traffic, slows travel and commerce, and can present potentially dangerous hazards. Thus, snow removal is required to clear driveways, sidewalks, parking lots and streets for safe use. Municipalities generally clear major throughways with large vehicles with snowplows. Many other smaller scale methods of snow removal are available, yet many methods are inconvenient or expensive for the average individual.

Common methods of snow removal available to a home or small business owner include a snow shovel, an electric or gas powered snow blower, and hiring a snow removal professional, but each poses their own drawbacks. Manual snow removal with a snow shovel is usually time consuming and can cause physical injuries such as back and muscle strains, headaches, heart attacks and slip and fall accidents. Snow blowers are expensive, require maintenance and repairs, are heavy and difficult to transport, and require the operator to be outside in the elements. Snow removal professionals can be expensive, sometimes requiring the customer to pay yearly fees even if there is no snowfall. Additionally, snow removal professionals may be unreliable or unavailable to clear property immediately, thus leaving customers without cleared property for hours or even days. They may even be careless when removing snow and damage a customer's property, causing further expense.

Another method of snow removal available to an individual is installing a snow plow on the individual's vehicle. However, the vehicle will usually require a large amount of horsepower, a powerful engine, and front wheel drive. Snow plows today are usually heavy and need to be professionally installed due to complicated machinery and wiring. Furthermore, snow plows cannot be easily detached and reattached, making this method of snow removal inefficient for individuals unless they are involved in a snow plowing business. Attempts have been made in the art to solve these problems. For example, Biance (U.S. Pat. No. 4,595,007) discloses a trailer-type snow plow designed to be pulled behind a vehicle. A plow blade is connected to a central member attached to the rear of a vehicle. The plow blade is connected so that it may pivot freely in a horizontal plane. A winch is mounted to the central portion to raise/lower the plow blade and blade extensions are connected to the plow blade to widen the area covered by the plow blade.

In another disclosure, Daniels (U.S. Pat. No. 5,046,271) provides a snow plow mounted to the rear of a vehicle. A Reese hitch must be mounted and welded to the vehicle chassis. The snow plow includes a lifting mechanism with a hydraulic system for raising and lowering the snow plow controlled by an electric control mounted in the dashboard of the vehicle.

Fulton (U.S. Pat. No. 6,202,328) discloses a snowplow mounted on the rear of a vehicle via a conventional trailer hitch. A support member connects to the trailer hitch and a blade support supporting a plow blade. A manual force applied to a fulcrum attached to the blade support assembly allows a user to raise the plow blade.

In yet another disclosure, Schmeichel (U.S. Pat. No. 7,131,221) provides a snow plow for use with trucks and sport utility vehicles. A mounting apparatus includes two uprights connected by an interconnecting member. A hitch tongue is secured to the interconnecting member and a hitch receiver of a vehicle. A plow blade having two retention members secures to the two uprights to complete a snow plow weighing approximately 250 pounds.

A snow plow for mounting to a trailer hitch receiver is disclosed in Lemieux et al. (U.S. Pub. No. 2009/0119954). A main frame is inserted into a trailer hitch receiver and a plow blade assembly is attached to the main frame. The plow blade assembly includes electrical and hydraulic circuits, a motor and a solenoid. A wireless receiver controller receives signals from a handheld wireless transmitter and operates the hydraulic system to raise or lower the plow blade assembly.

The prior art snow plows described above still remain generally inconvenient for the average person unfamiliar with snow plowing. Some snow plows are difficult to attach or remove, requiring professional permanent installation or requiring them to remain attached throughout the entire season of snow fall. Even if the plow is removable, they are heavy and unmanageable by one person. Further, the prior art snow plows tend to be complicated, having many parts and complex mechanical, electrical or hydraulic functions. Furthermore, lengthy and expensive maintenance is required if the snow plows malfunction or break.

Therefore, a need in the art exists for a lightweight, compact and easy to use snow plow that a single individual can attach and remove from an existing vehicle hitch.

SUMMARY OF THE INVENTION

In a first aspect hereof, the present invention provides a snow plow towing hitch system comprising:

a connecting bar removably attachable to a vehicle hitch, (b) a vertical support bar attached to the connecting bar and having a first arm, a second arm and a stopper arm projecting therefrom, (c) a plow blade rotatably attached to the first and second arm of the vertical support bar, the plow blade having a stopper to contact the stopper arm and prevent rotation of the snow plow in a direction towards the vehicle hitch, and (d) a spring attached to the stopper and the stopper arm, the spring being in tension to vertically orient the plow blade.

In a further aspect hereof, there is provided:

(a) a connecting bar having a first end removably attachable to a vehicle hitch and a second end having a pair of spaced protrusions with apertures therein, (b) a vertical support bar having a first end with an aperture therethrough and a second end having first, second and third arms projecting therefrom, the first end of said vertical support bar being positioned between the pair of spaced protrusions, each of the arms having proximal and distal ends, (c) a locking bar extending through the apertures of the pair of spaced protrusions of the connecting bar and the aperture of the first end of the vertical support bar to couple the connecting bar and the vertical support bar, (d) a plow blade having a front face for moving snow and a rear face, the rear face having a stopper and a pair of brackets, the brackets secured to the rear face and cooperating to define concentric apertures, (e) a plow bar extending through the concentric apertures of the pair of brackets and distal ends of the first and second arms of the vertical support bar to rotatably attach the plow blade to the vertical support bar, and (f) a spring attached to the third arm of the vertical support bar and the stopper, the spring being in tension to vertically orient the plow blade. The stopper contacts the third arm preventing rotation of the plow blade in both a first rotational direction and in a second rotational direction.

Another aspect of the present invention provides a snow plow towing hitch system with a connecting bar comprising an elongate member having a first end removably attachable to the vehicle hitch and a second end with a rounded projection. The rounded projection has slotted apertures therein to receive the vertical support bar. Each slotted aperture orients the vertical support bar and an attached snow plow in a specific direction.

Another aspect of the present invention provides a snow plow towing hitch system with a connecting bar comprising an elongate member having a first end removably attachable to a vehicle hitch and a second end having a plate rotatably coupled thereto. A vertical support bar is attached to the plate. The plate is selectively rotatable to orient the vertical support bar and an attached snow plow in a desired direction.

An alternative embodiment of the present invention provides a snow plow towing hitch system assembly kit comprising:

a vertical support bar having a generally inverted U-shape, the bar comprising a plurality of tubular members and means for connecting the tubular members together, (b) a plow blade having a front face for moving snow, a rear face, and a snow shovel handle aperture, the rear face including a pair of spaced apart brackets secured thereto, the pair of brackets defining a pair of concentric apertures when secured to the rear face, (c) a plow bar extending through the concentric apertures of the pair of brackets at each end of the vertical support bar to rotatably attach the plow blade to the vertical support bar, and (d) a spring attached to the vertical support bar and the rear face of the plow blade, the spring vertically orienting the plow blade and allowing limited rotation of the plow blade. The vertical support bar, the plow blade, the plow bar and the spring can be assembled by a user from a kit for removable attachment to a vehicle hitch and disassembled by said user.

Another aspect of this embodiment of the present invention provides a snow plow towing hitch system assembly kit having a plow blade that can be disassembled from the snow plow towing hitch system assembly kit to enable a snow shovel handle to be attached to the blade, thus allowing the plow blade to be used as a manual snow shovel.

For a more complete understanding of the present invention, reference is made to the following detailed description and accompanying drawings. In the drawings, like reference characters refer to like parts throughout the views in which:

BRIEF DESCRIPTION OF THE DRAWINGS

FIG. 3 is an alternative embodiment of a connecting bar of the snow plow towing hitch system depicted in FIG. 1;

FIG. 4 is a is a second alternative embodiment of a connecting bar of the snow plowing hitch system depicted in FIG. 1;

FIG. 5 is a is a third alternative embodiment of a connecting bar of the snow plowing hitch system depicted in FIG. 1.

DETAILED DESCRIPTION OF THE PREFERRED EMBODIMENT

The following description of the preferred embodiment is merely exemplary in nature and is in no way intended to limit the invention, its application, or uses.

Figure 1:
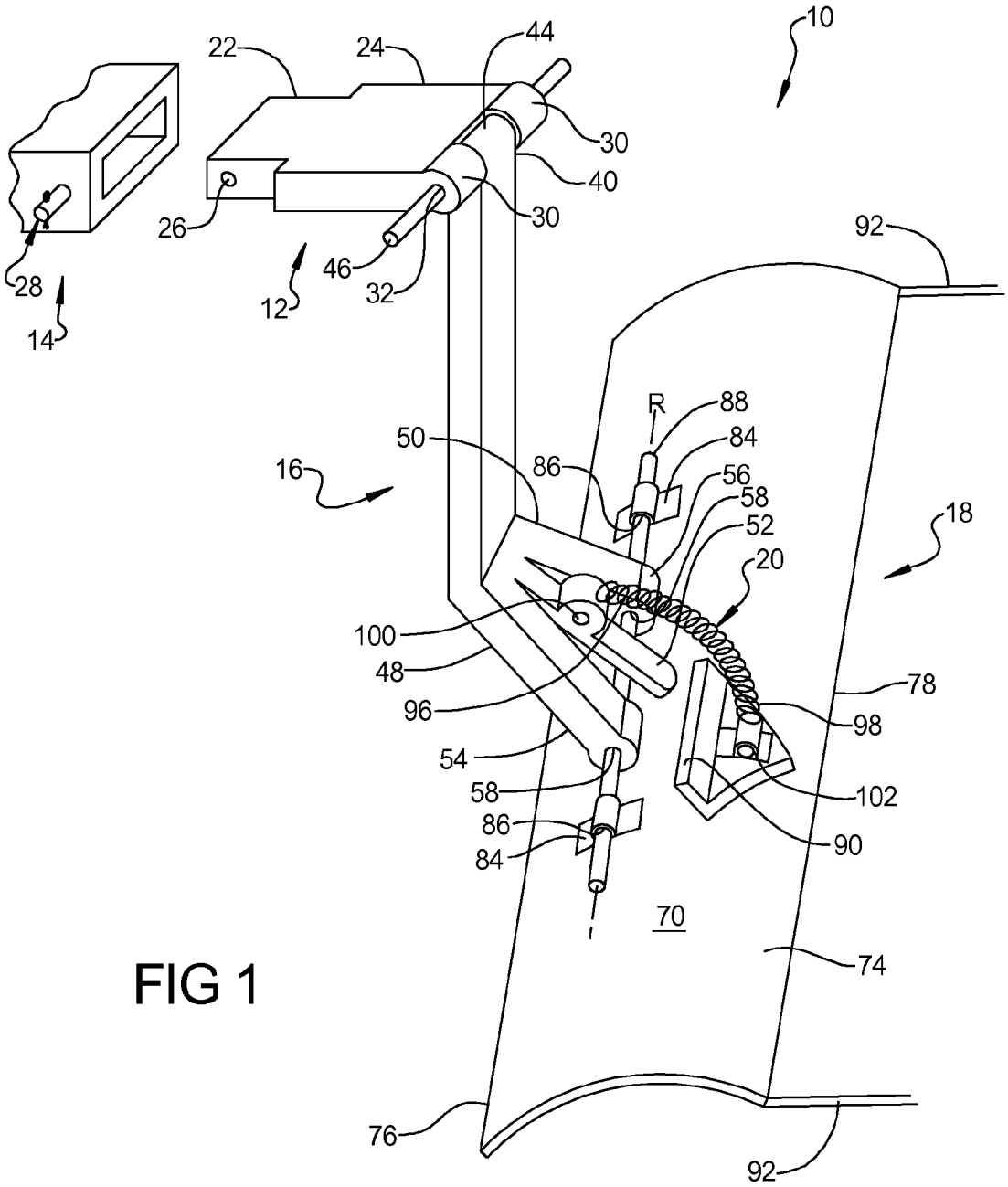
FIG. 1 is a perspective view of a snow plow towing hitch system of the present disclosure.
Figure 2:
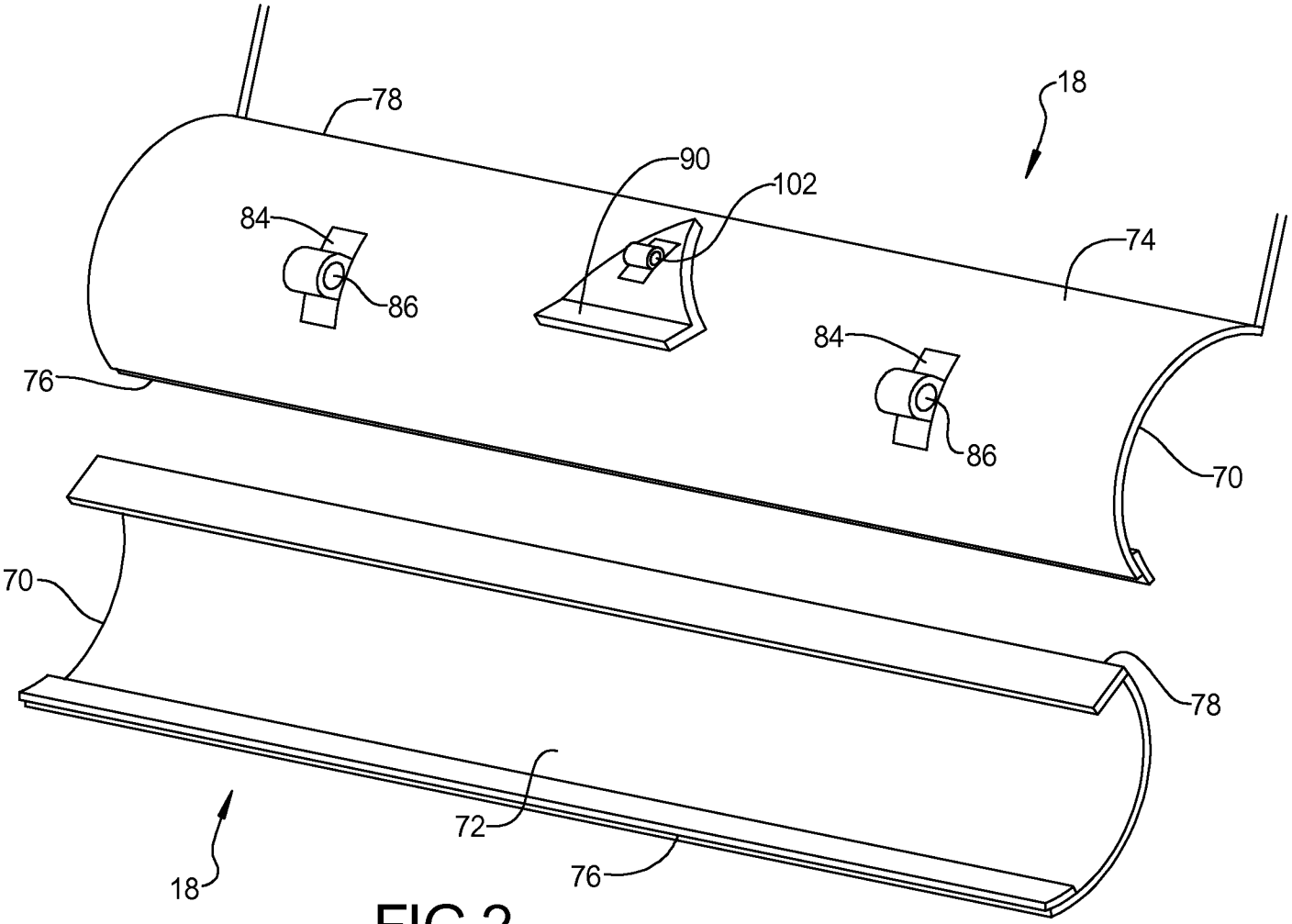
FIG. 2 is a front and rear view of a plow blade of the snow plow towing hitch system depicted in FIG. 1.

With reference to FIGS. 1 and 2 of the drawings, a snow plow towing hitch system constructed in accordance with the teachings of the present invention is generally identified by the reference numeral 10. Generally, the system of the present invention includes a connecting bar 12 connected to a vehicle hitch 14, a vertical support bar 16 attached to the connecting bar 12, a plow blade 18 rotatably attached to the vertical support bar 16, and a spring 20 attached to the vertical support bar 16 and the plow blade 18 to limit rotation of the plow blade 18. The snow plow towing hitch system 10 is easily attached to and removed from the vehicle hitch 14 by a single individual and allows that individual to plow snow safely from a warm vehicle.

The connecting bar 12 comprises an elongated member preferably made of metal and having a first end 22 and a second end 24. The first end 22 is configured to be received by the hitch 14. The first end 22 includes an aperture 26 therethrough to align with conventional connection means of the hitch 14, for example a bar and pin 28, allowing the connecting bar 12 to be easily attached and removed from the hitch 14 by a single operator. The second end 24 includes two spaced apart prongs 30 having aligned apertures 32 therethrough for connecting the vertical support bar 16 to the connecting bar 12 as described below.

The vertical support bar 16 is an elongated member made of a rigid material such as metal or wood and is attached to the connecting bar 12 by any suitable means such as a threaded member or the like. The vertical support bar 16 has a first end 40 and a second end 42. The first end 40 includes an aperture 44 formed therethrough and which is sized to fit between the prongs 30 of the connecting bar 12. The first end 40 is oriented such that the aperture 44 aligns with the apertures 32 of the prongs 30.

A locking bar 46 extends through the apertures 32 to attach the vertical support bar 16 to the connecting bar 12. The locking bar 46 is secured in place by conventional pins (not shown). The second end 42 of the vertical support bar 16 includes a pair of elongated arms 48, 50 extending therefrom and a stopper arm 52 located between the pair of elongated arms 48, 50 and similarly extending from the second end 42. Each elongated arm 48, 50 has a respective distal end 54, 56 each having concentric apertures 58 for further connections to the plow blade 18, as described below.

The plow blade 18 is rotatably attached to the vertical support bar 16, preferably, in a hinge-like fashion via a plow bar 88, as described below. The plow blade 18 includes a curved body 70 having a front face 72, a rear face 74, a bottom edge 76 and a top edge 78. The curved body 70 is preferably made of metal or hard plastic. The bottom edge 76 may include a metal or hard rubber strip along its length to scrape snow off the ground. The top edge 78 may include a rubber flap to assist in the collection of snow, as well as a pair of position flags 92 on either end to help the user determine the position of the plow blade 18 while the user is in a vehicle.

The rear face 74 includes a plow blade stopper 90 to limit rotation of the plow blade 18 and a pair of opposed attachment brackets 84 having opposed legs and an intermediate arcuate member, which when secured to the rear face 74 forms apertures 86. The apertures 86 in the attachment brackets 84 align with the apertures 58 of the elongated arms 48, 50 of the vertical support bar 16. The plow bar 88 extends through the apertures 58, 86 to rotatably couple the plow blade 18 to the vertical support bar 16. The plow bar is secured in place by conventional pins (not shown). Thus, the plow blade 18 has a rotational axis R concentric with the plow bar 88.

The stopper 90 functions to prevent rotation of the plow blade 18 when a greater force is placed near the top edge 78 of the front face 72 than the force on the bottom edge 76, once the stopper 90 comes into contact with the stopper arm 52 of the vertical support bar 16. The stopper 90 thus acts to keep the bottom edge 76 of the plow blade 18 in close proximity of the ground during use.

The spring 20 includes a first end 96 and a second end 98. The first end 96 is connected to a first spring bracket 100 attached to the stopper arm 52 of the vertical support bar 16, such as by a hook and loop connection. The second end 98 of the spring 20 is connected in a similar way to a second spring bracket 102 attached to the stopper 90 of the plow blade 18. The spring 20 is in tension and operates to keep the plow blade 18 in a generally vertical orientation when at rest. If the plow blade 18 encounters an obstruction on the ground, the plow blade 18 rotates towards a lateral orientation to ride over the obstruction. Once the obstruction is cleared, the spring 20 operates to return the plow blade 18 to a vertical orientation.

With reference to FIG. 3, a second embodiment of the connecting bar is indicated by reference numeral 212.

According to this embodiment, the connecting bar 212 is an elongated member, preferably, made of metal and includes a first end 222 and a second end 224. The first end 222 is configured to be received by the hitch 14. The first end 222 includes an aperture 226 therethrough to align with the conventional means for connection of the connecting bar 212 to the hitch 14. The second end 224 is a circular projection having three slotted apertures 230, 232 and 234 for selectively receiving the first end 40 of the vertical support bar 16. The first end 40 of the vertical support bar is secured to the second end 224 of the connecting bar 212 by inserting the connecting pin 28 through the aperture 44 once the first end 40 is inserted through either of apertures 230, 232 or 234. Each slotted aperture is oriented such that the angle at which the vertical support bar 16 is oriented and, therefore, the angle of the plow blade 18, may be varied. The first end 40 may be received by the slotted aperture 230 to orient the plow blade 18 parallel to the rear of the vehicle, thereby plowing snow in a direction parallel to the direction of movement of the vehicle. Alternatively, the first end 40 may be received by the slotted aperture 232 or 234 to angle the plow blade 18, thereby allowing snow to be plowed to either side of the vehicle. Thus, the connecting bar 212 allows a single individual to quickly and easily adjust the angle of the plow blade 18 relative to the vehicle.

With reference to FIG. 4, a third embodiment of the connecting bar is indicated by reference numeral 312. According to this embodiment, the connecting bar 312 comprises a body 314 and a directional plate 316 rotatably attached to the body 314, such as by a rotation pin 328. The directional plate 316 enables rotation of the plow blade 18 in a desired direction for plowing snow.

The body 314 includes a first end 322 and a second end 324. The first end 322 is configured to be received by the hitch 14. The first end 322 includes an aperture 326 therethrough to align with conventional connection means of the hitch. The second end 324 is stepped and receives the directional plate 316. The directional plate 316 is rotatably mounted to the second end 324 by rotation pin 328 and includes a first end 330 and a second end 332. The first end 330 includes a plurality of adjustment apertures 334 and the second end 332 includes two spaced apart prongs 336 having aligned apertures 338 therethrough. The prongs 336 define means for attaching the vertical support bar 16 to the connecting bar 312 in a manner similar to that described with respect to the connecting bar 12.

The directional plate 316 may be rotated in a desired direction about the pivot pin 328 and is secured in the desired direction by placing a pin (not shown) through one or more of the adjustment apertures 334. By rotating the directional plate 316, the vertical support bar 16, and therefore the plow blade 18, may be rotated to adjust the direction in which snow is plowed. Thus, the connecting bar 312, much like the connecting bar 212, allows a single individual to quickly and easily vary the angle of the plow blade 18 relative to the vehicle.

With reference to FIG. 5, a fourth embodiment of the connecting bar is indicated by reference numeral 412. According to this embodiment, the connecting bar 412 includes a hitch receiver attachment portion 414 rigidly secured to a ball hitch 416. The hitch receiver portion 414 includes an aperture 426 therethrough to align with conventional connection means of the hitch 14 in a fashion similar to the connecting bar 12. The ball hitch 416 includes a standard ball mount 428 used for towing and trailers. The first end 40 of the vertical support bar 16 further includes a ball hitch attachment 430 rigidly attached thereto. The ball hitch attachment 430 is removably secured to the ball mount 428 to connect the snow plow hitch system 10 to a vehicle.

Figure 6:
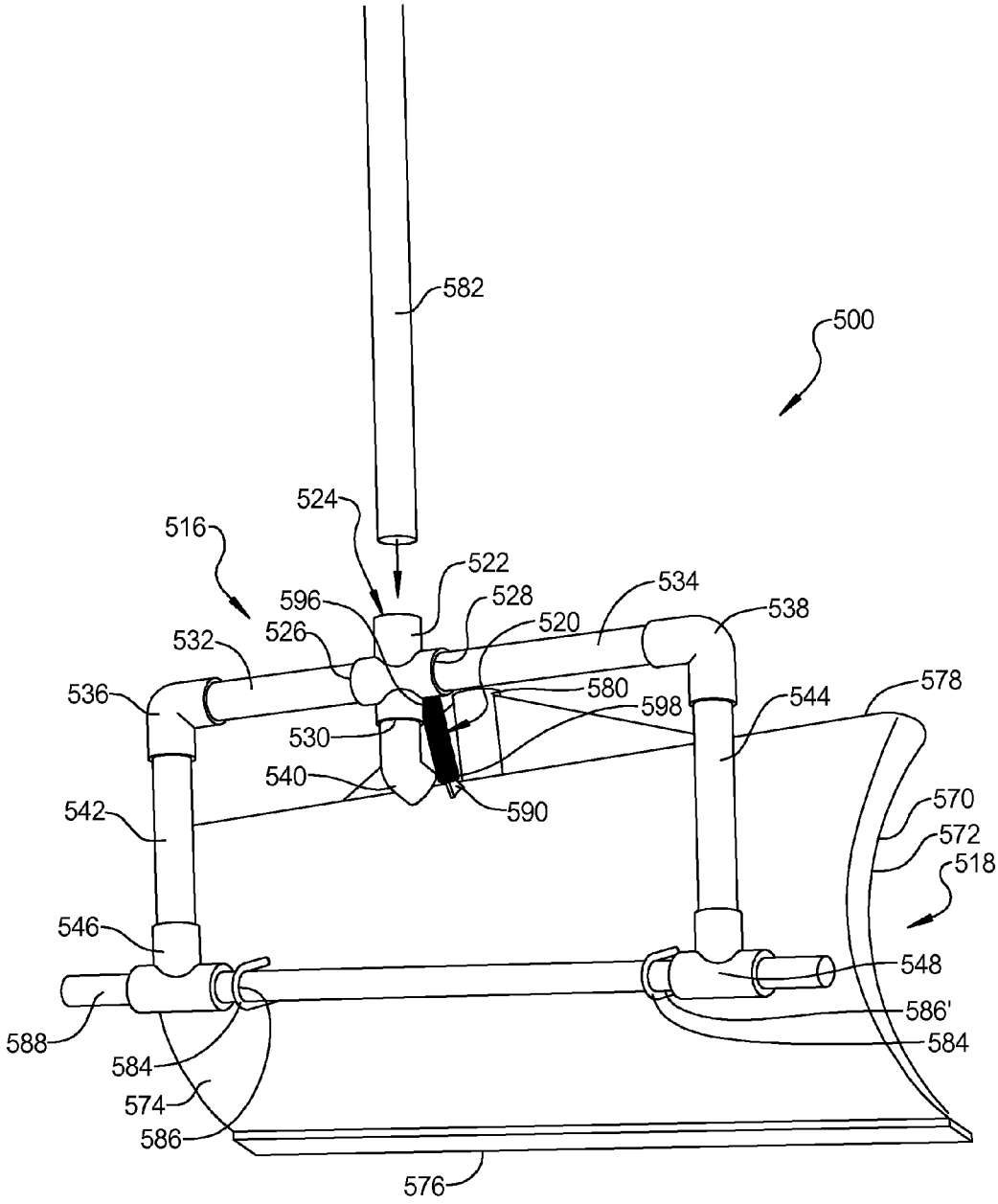
FIG. 6 is a perspective view of an alternative embodiment of a snow plow towing hitch system.

With reference to FIG. 6, an alternate embodiment of the snow plow towing hitch system is provided as an assembly kit form denoted 500. The snow plow towing hitch system assembly kit 500 allows the owner to quickly and easily assemble a lightweight snow plow towing hitch system for attachment to one or more of the connecting bars described above. The assembly kit 500 is also easily disassembled for storage or portions can be used as a standard snow shovel. Generally, the snow plow towing hitch system assembly kit 500 comprises a vertical support bar 516, a plow blade 518 rotatably attached to the vertical support bar 516, and a spring 520 attached to the vertical support bar 516 and the plow blade 518 to limit rotation of the plow blade 518.

The vertical support bar 516 is initially a grouping of unassembled components which, when assembled, form an inverted generally U-shaped tubular member. The components are preferably made from PVC piping and connections or other strong and durable material. The assembled vertical support bar 516 includes a four-way coupling 522 having coupling apertures 524, 526, 528 and 530. The coupling aperture 524 is operable to receive an adapter (not shown) to connect the vertical support bar 516 to the vehicle hitch 14. A pair of crossbar members 532 and 534 each extend laterally from a pair of the coupling apertures 526 and 528, respectively. The end of the crossbar member 532 opposite the four-way coupling 522 is fittingly accepted by an elbow joint 536. Similarly, the crossbar member 534 is fittingly connected to an elbow joint 538. Each of a pair of arm sections 542 and 544 extend downwardly from each of the elbow joints 536 and 538, respectively. The end of the arm section 542 opposite the elbow joint 536 is fittingly accepted by a tee joint 546. Similarly, the arm section 544 is fittingly accepted by a tee joint 548. A stopper elbow joint 540 is fittingly accepted by the coupling aperture 530 such that the free end of the elbow joint 540 extends toward the plow blade 518 when assembled. The stopper elbow joint 540 operates to prevent rotation of the plow blade 518 towards the vehicle.

The plow blade 518 is rotatably attached to the vertical support bar 516, such as in a hinge-like fashion with a plow bar 588, as will be described below. The plow blade 518 is a snow shovel blade, preferably made of hard plastic or metal. The plow blade 518 includes a curved body 570 having a front face 572, a rear face 574, a bottom edge 576, and a top edge 578 having a handle aperture 580 for selectively removably receiving a snow shovel handle 582. The bottom edge 576 may include a metal or hard rubber strip along its length to scrape snow off the ground. The rear face 574 includes a pair of opposed U-shaped attachment brackets 584 having legs extending through the body 570 and secured thereto with threaded nuts or the like (not shown). Once secured, each of the brackets 584 define apertures 586, 586'. The apertures 586, 586' of the brackets 584 align with the tee joints 546 and 548 of the vertical support bar 516. The plow bar 588 extends through the tee joints 546, 548 and the apertures 586, 586' to rotatably couple the plow blade 518 to the vertical support bar 516.

The spring 520 includes a first looped end 596 and a second looped end 598. The first looped end 596 is connected to the four-way coupling 522 of the vertical support bar 516 in a conventional manner, such as by a zip tie 590 extending around the coupling 522 and through the first looped end 596. The second looped end 598 is connected in a similar way to the rear face 574 of the plow blade 518. The spring 520 is in tension and operates much like the spring 20 described above.

The plow blade 518 may be used as a manual shovel by attaching the handle 582 via the aperture 580.

The snow plow hitch system 10 and its alternate embodiments described above thus provide a lightweight snowplow that is easily attached to and removed from an existing vehicle hitch by a single individual. The snow plow hitch system 10 allows the user to plow driveways, parking lots and other areas while remaining in a warm vehicle, then quickly remove the snow plow hitch system 10 for storage. The snow plow hitch system 10 is easily transported and stored, allowing the owner to attach the snow plow only when needed and to store it when not in use. The snow plow hitch system 10 is also easily adjusted to change the angle at which snow is plowed, giving the user increased flexibility for specific plowing situations.

The foregoing discussion discloses and describes merely exemplary embodiments of the present invention. One skilled in the art will recognize from the discussion, and from the accompanying drawings and claims, that various changes, modifications and variations may be made therein without departing from the spirit and scope of the invention as defined in the following claims.

What is claimed is:

1. A snow plow towing hitch system comprising:

(a) a connecting bar removably attachable to a vehicle hitch, the connecting bar being an elongated member having a first end and a second end, the first end of the connecting bar being attachable to the vehicle hitch;

(b) a vertical support bar attached to said connecting bar, the vertical support bar being a single elongated member having a first end and a second end, the first end of the vertical support bar being pivotally attached to the second end of the connecting bar, the vertical support bar having a first arm, a second arm and a stopper arm projecting therefrom, the first arm, second arm, and stopper arm being rigidly attached to and extending from the second end of the vertical support bar, the first arm and the second arm each terminating at a distal end thereof;

(c) a plow blade rotatably attached to the distal ends of said first and second arm of said vertical support bar, said plow blade having a stopper to contact said stopper arm and prevent rotation of said plow blade in a direction towards said vehicle hitch; and (d) a spring attached to said stopper and said stopper arm, said spring being in tension to orient the plow blade vertically.

2. The snow plow system of claim 1 wherein said connecting bar is metal.

3. The snow plow system of claim 1 wherein said connecting bar comprises an elongate member having a first end removably attachable to said vehicle hitch and a second end with a rounded projection, said rounded projection having slotted apertures therein to receive said vertical support bar, wherein each slotted aperture orients said vertical support bar in a specific direction.

4. The snow plow system of claim 3 further including a locking bar to removably attach said vertical support bar to said connecting bar when said vertical support bar is received by one of said slotted apertures, wherein said locking bar is inserted through an aperture in said vertical support bar and rests against said rounded projection.

5. The snow plow system of claim 1 wherein said connecting bar comprises an elongate member having a first end removably attachable to said vehicle hitch and a second end having a plate rotatably coupled thereto, said vertical support bar attached to said plate, wherein said plate is selectively rotatable to orient said vertical support bar in a desired direction.

6. The snow plow system of claim 5 wherein said plate includes a pair of spaced projections with apertures therein, said vertical support bar oriented between said pair of spaced projections, wherein a locking bar inserted through said apertures of spaced projections and an aperture in said vertical support bar to attach said vertical support bar to said connecting bar.

7. The snow plow system of claim 1 wherein said connecting bar includes a hitch receiver attachment portion operable to removably attach to said vehicle hitch and a ball hitch portion having a ball mount rigidly attached thereto.

8. The snow plow system of claim 7, wherein said vertical support bar further includes a ball hitch attachment operable to connect said vertical support bar to said ball mount of said connecting bar.

* * * * *